US010388207B2

(12) United States Patent
Chang et al.

(10) Patent No.: US 10,388,207 B2
(45) Date of Patent: Aug. 20, 2019

(54) EXTERNAL COMPENSATION METHOD AND DRIVER IC USING THE SAME

(71) Applicant: NOVATEK Microelectronics Corp., Hsin-Chu (TW)

(72) Inventors: Hua-Gang Chang, Hsinchu County (TW); Shang-I Liu, Kaohsiung (TW); Chun-Chieh Lin, Taipei (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 159 days.

(21) Appl. No.: 15/238,728

(22) Filed: Aug. 17, 2016

(65) Prior Publication Data

US 2017/0352305 A1 Dec. 7, 2017

Related U.S. Application Data

(63) Continuation-in-part of application No. 15/187,809, filed on Jun. 21, 2016.

(60) Provisional application No. 62/345,848, filed on Jun. 5, 2016.

(51) Int. Cl.

| | |
|---|---|
| ***G09G 3/32*** | (2016.01) |
| ***G09G 3/20*** | (2006.01) |
| ***G09G 3/3225*** | (2016.01) |
| ***G09G 3/3275*** | (2016.01) |

(52) U.S. Cl.

CPC ..... *G09G 3/2085* (2013.01); *G09G 3/3225* (2013.01); *G09G 3/3275* (2013.01); *G09G 2310/027* (2013.01); *G09G 2310/0291* (2013.01); *G09G 2310/0297* (2013.01); *G09G 2320/0233* (2013.01); *G09G 2320/043* (2013.01)

(58) Field of Classification Search

CPC .. G09G 3/2085; G09G 3/3225; G09G 3/3275; G09G 2310/027; G09G 2310/0291; G09G 2310/0297; G09G 2320/0233; G09G 2320/043

See application file for complete search history.

(56) References Cited

U.S. PATENT DOCUMENTS

| | | | | |
|---|---|---|---|---|
| 7,414,599 | B2 | 8/2008 | Chung | |
| 8,259,044 | B2 | 9/2012 | Nathan | |
| 8,264,478 | B2 * | 9/2012 | Kim | G09G 3/3688 345/204 |
| 8,988,329 | B2 | 3/2015 | Yoon | |
| 2009/0174649 | A1 | 7/2009 | Kim | |
| 2014/0152721 | A1 | 6/2014 | Byun | |

(Continued)

FOREIGN PATENT DOCUMENTS

| | | | |
|---|---|---|---|
| CN | 102103827 | A | 6/2011 |
| CN | 102968954 | A | 3/2013 |

(Continued)

*Primary Examiner* — Towfiq Elahi
(74) *Attorney, Agent, or Firm* — Winston Hsu

(57) ABSTRACT

An external compensation method for devices in a panel which comprises a plurality of sub-pixels, includes programming a first device in a first sub-pixel among the plurality of sub-pixels via a first line and sensing the first device via a second line during a first period; and programming a second device in a second sub-pixel among the plurality of sub-pixels via the second line and sensing the second device via the first line or a third line during a second period.

9 Claims, 12 Drawing Sheets

(56) References Cited

U.S. PATENT DOCUMENTS

| | | | | |
|---|---|---|---|---|
| 2014/0354711 | A1* | 12/2014 | In | G09G 3/3233 345/691 |
| 2015/0077314 | A1 | 3/2015 | Kim | |
| 2016/0086548 | A1 | 3/2016 | Maeyama | |
| 2017/0287390 | A1* | 10/2017 | Lee | G09G 3/325 |
| 2017/0289805 | A1 | 10/2017 | Hong | |

FOREIGN PATENT DOCUMENTS

| | | | |
|---|---|---|---|
| CN | 103413515 | A | 11/2013 |
| CN | 104021761 | A | 9/2014 |
| CN | 103236237 | B | 4/2015 |
| CN | 104658474 | A | 5/2015 |
| CN | 103177685 | B | 6/2015 |
| CN | 104700761 | A | 6/2015 |

* cited by examiner

EXTERNAL COMPENSATION METHOD AND DRIVER IC USING THE SAME

CROSS REFERENCE TO RELATED APPLICATIONS

This application is a continuation-in-part application of U.S. application Ser. No. 15/187,809, filed on Jun. 21, 2016. This application further claims the benefit of U.S. Provisional Application No. 62/345,848, filed on Jun. 5, 2016. The contents of these applications are incorporated herein by reference.

BACKGROUND OF THE INVENTION

1. Field of the Invention

The present invention relates to an external compensation method and a related driver integrated circuit (IC), and more particularly, to an external compensation method for a panel and a driver IC performing the external compensation method on the panel.

2. Description of the Prior Art

An organic light-emitting diode (OLED) is a light-emitting diode (LED) in which the emissive electroluminescent layer is a film of organic compound, where the organic compound can emit light in response to an electric current. OLEDs are widely used in displays of electronic devices such as television screens, computer monitors, portable systems such as mobile phones, handheld game consoles and personal digital assistants (PDAs). An active matrix OLED (AMOLED), which is driven by a thin-film transistor (TFT) which contains a storage capacitor that maintains the pixel states to enable large size and large resolution displays, becomes the mainstream of the OLED displays.

In a general OLED display, each pixel cell includes three sub-pixels, each of which has an OLED with one of the three primary colors, for composing a target color to be displayed in the pixel cell. A sub-pixel receives a voltage signal from a driver integrated circuit (IC). A TFT then converts the voltage signal into a driving current, which drives the OLED to emit light. The luminance of the OLED is determined by the driving current of the OLED. However, in the OLED display, the TFT indifferent sub-pixels may possess an error or mismatch in the device parameter, which may result in different voltage-to-current conversion behaviors. In addition, there may also be a mismatch in the luminous efficiency of the OLED. After a long-time operation, the OLED display may undergo degradations in voltage-to-current conversion and luminous efficiency. Therefore, the uniformity of the OLED display may be decreased since different locations on the OLED display may possess different levels of degradations.

In order to improve the uniformity of the OLED display, an efficient compensation method for OLED and TFT parameters is required. An external compensation is a common compensation method for the OLED display. Please refer to FIG. 1, which is a schematic diagram of a panel 100 implemented with a common external compensation method. The panel 100 includes a plurality of sub-pixels arranged in a matrix form. For each column of sub-pixels, a source line connects the sub-pixels to a driver IC (not illustrated), which outputs display data to the TFTs in sub-pixels via the source line. In addition, a sensing line is also coupled between each column of sub-pixels and the driver IC. The sensing line, which is used for external compensation, may transmit the electrical characteristics of the TFTs or OLEDs in the sub-pixels to the driver IC, allowing the driver IC to perform follow-up processing based on the received data. In such a situation, each column of sub-pixels requires two lines for communicating with the driver IC, such that the driver IC may have a great number of I/O pins; this increases the cost of the driver IC. If there are N columns of sub-pixels in the panel 100, 2N lines are required for data display and external compensation operations. For example, a full-HD OLED display includes 1080 columns of pixels, i.e., 1080×3 columns of sub-pixels, and therefore the driver IC is required to include 1080×6 I/O pins connected with the lines (1080×3 for source lines and 1080×3 for sensing lines). The great number of I/O pins increases the cost of the driver IC. Thus, there is a need for improvement over the prior art.

SUMMARY OF THE INVENTION

It is therefore an objective of the present invention to provide an external compensation method for a panel and a driver integrated circuit (IC) performing the external compensation method on the panel, in order to solve the above problems.

The present invention discloses an external compensation method for devices in a panel, which comprises a plurality of sub-pixels. The external compensation method comprises programming a first device in a first sub-pixel among the plurality of sub-pixels via a first line and sensing the first device via a second line during a first period; and programming a second device in a second sub-pixel among the plurality of sub-pixels via the second line and sensing the second device via the first line or a third line during a second period.

The present invention further discloses a driver IC for a panel, for performing external compensation on the panel. The driver IC comprises a plurality of lines, a first digital to analog converter (DAC) and a first output buffer, a second DAC and a second output buffer, a multiplexer (MUX) and an analog to digital converter (ADC). The plurality of lines are coupled to the panel. The first DAC and the first output buffer are coupled to a first line among the plurality of lines. The second DAC and the second output buffer are coupled to a second line among the plurality of lines. The ADC is coupled to the first line and the second line via the MUX.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, if there are N columns of sub-pixels in the panel, 2N lines are required for data display and external compensation operations. In order to reduce the line number of the panel and the corresponding pin count of the driver integrated circuit (IC), the source line and sensing line may be shared by different columns of sub-pixels. For example, a source line for a sub-pixel may be a sensing line for another sub-pixel.

Figure 2:
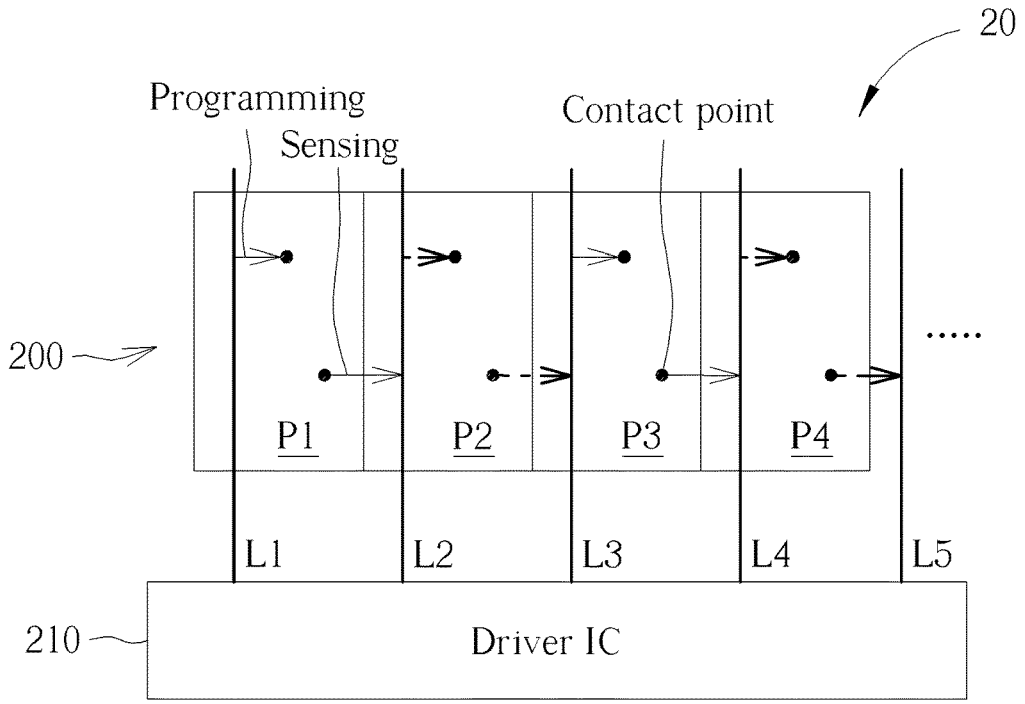
FIG. 2 is a schematic diagram of an organic light-emitting diode (OLED) display system according to an embodiment of the present invention.

Please refer to FIG. 2, which is a schematic diagram of an organic light-emitting diode (OLED) display system 20 according to an embodiment of the present invention. As shown in FIG. 2, the OLED display system 20 includes a panel 200 and a driver IC 210. The panel 200 includes a plurality of sub-pixels arranged in a matrix form, and the panel 200 is coupled to the driver IC 210 via a plurality of lines. In FIG. 2, only 4 sub-pixels P1-P4 and 5 lines L1-L5 are illustrated for simplicity. Those skilled in the art should realize that there may be hundreds or thousands of columns of sub-pixels and lines in the panel 200.

Figure 1:
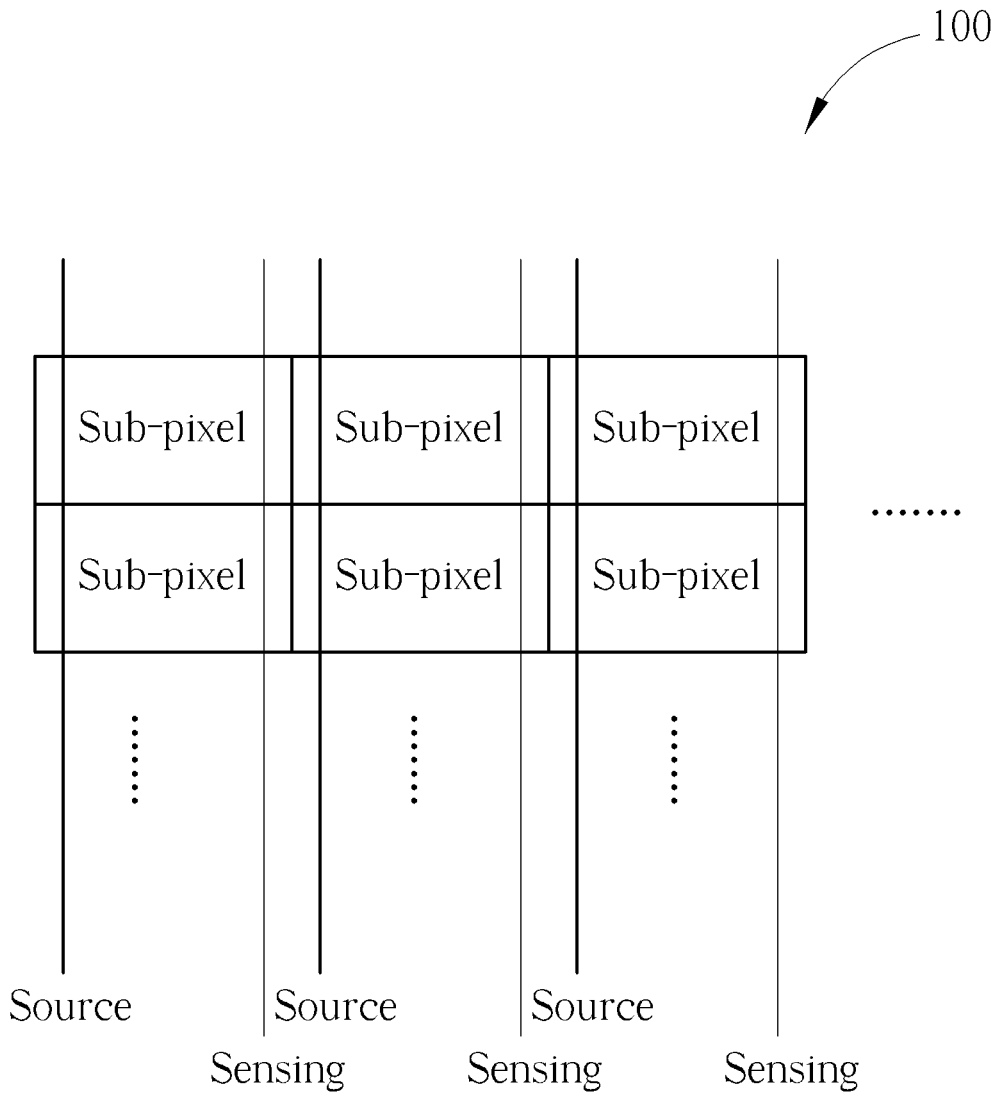
FIG. 1 PRIOR ART
FIG. 1 is a schematic diagram of a panel implemented with a common external compensation method.

As shown in FIG. 2, each sub-pixel has 2 contact points, for connecting to the driver IC 210 via two lines. For example, the sub-pixel P1 is connected to the driver IC 210 via lines L1 and L2, the sub-pixel P2 is connected to the driver IC 210 via lines L2 and L3, and so on. In this manner, each line is shared by two adjacent sub-pixels. For example, the line L2 is shared by the sub-pixels P1 and P2, the line L3 is shared by the sub-pixels P2 and P3, and so on. Due to sharing of the lines, the line number is significantly decreased in comparison with the line number of the panel 100 shown in FIG. 1. In this embodiment, if there are N columns of sub-pixels in the panel 200, N+1 lines are enough for data display and external compensation operations of the OLED display system 20. Accordingly, the pin count of the driver IC 210 may also be reduced.

In a display mode where the panel 200 displays an image according to the data from the driver IC 210, the data to be displayed in each column of sub-pixels are transmitted via each column of line. For example, the sub-pixel P1 receives data from the line L1, the sub-pixel P2 receives data from the line L2, and so on. In a compensation mode where the driver IC 210 performs external compensation on devices in the panel 200, the driver IC 210 may program a device in a sub-pixel via a line and sense the device via another line. For example, the driver IC 210 may program a device in the sub-pixel P1 via the line L1, and sense the device in the sub-pixel P1 via the line L2. The driver IC 210 may program a device in the sub-pixel P2 via the line L2, and sense the device in the sub-pixel P2 via the line L3.

More specifically, as shown in FIG. 2, for the sub-pixel P1, an arrow starting from the line L1 to a contact point of the sub-pixel P1 indicates that the line L1 acts as a source line for programming a device in the sub-pixel P1 with a specific voltage signal; and an arrow starting from another contact point of the sub-pixel P1 to the line L2 indicates that the line L2 acts as a sensing line for receiving electrical characteristics of the device in the sub-pixel P1. For the sub-pixel P2, an arrow starting from the line L2 to a contact point of the sub-pixel P2 indicates that the line L2 acts as a source line for programming a device in the sub-pixel P2 with a specific voltage signal; and an arrow starting from another contact point of the sub-pixel P2 to the line L3 indicates that the line L3 acts as a sensing line for receiving electrical characteristics of the device in the sub-pixel P2. By the same token, according to directions of the arrows shown in FIG. 2, those skilled in the art can realize the programming and sensing operations in every sub-pixel of the panel 200.

In this embodiment, each of the lines is used as the source line and sensing line alternately, except for the first column of line and the last column of line. The programming and sensing operations of the entire panel 200 may be completed in two periods. During the first period, the driver IC 210 may program the device in the sub-pixel P1 via the line L1 and sense the device in the sub-pixel P1 via the line L2. Therefore, the programming operation via the line L1 and the sensing operation via the line L2 for the sub-pixel P1 may be performed at the same time. In the same manner, the driver IC 210 may program the device in the sub-pixel P3 via the line L3 and sense the device in the sub-pixel P3 via the line L4 during the first period. During the second period, the driver IC 210 may program the device in the sub-pixel P2 via the line L2 and sense the device in the sub-pixel P2 via the line L3. Therefore, the programming operation via the line L2 and the sensing operation via the line L3 for the sub-pixel P2 may be performed at the same time. In the same manner, the driver IC 210 may program the device in the sub-pixel P4 via the line L4 and sense the device in the sub-pixel P4 via the line L5 during the second period. As shown in FIG. 2, the solid arrow indicates that the programming or sensing operation is performed during the first period, and the dashed arrow indicates that the programming or sensing operation is performed during the second period.

In such a situation, the sub-pixels of the panel 200 may be separated into two groups of sub-pixels. The devices in the first group of sub-pixels are programmed and sensed during the first period and the devices in the second group of sub-pixels are programmed and sensed during the second period. In this embodiment, the first group of sub-pixels includes odd columns of sub-pixels, i.e., the sub-pixels P1, P3 . . . , and the second group of sub-pixels includes even columns of sub-pixels, i.e., the sub-pixels P2, P4 . . . .

Please note that the above arrangement of programming and sensing operations is only one of various possible embodiments of the present invention. For example, in another embodiment, the even columns of sub-pixels may undergo programming and sensing during the first period and the odd columns of sub-pixels may undergo programming and sensing during the second period. In order to further reduce the pin count of the driver IC, a multiplexer (MUX) may be coupled between an I/O pin of the driver IC and two lines corresponding to two columns of sub-pixels. In such a situation, one I/O pin of the driver IC may selectively communicate with two lines via the MUX, where the programming and sensing operations of the entire panel may be completed in more periods, e.g., four periods. As a result, the pin count of the driver IC can further be reduced by half. This allows the external compensation method of the present invention implemented via line sharing to be applied to a small-scale display system such as a touch screen of a smartphone.

Further note that the lengths of the first period and the second period are configurable. In other words, each programming and sensing operation may be performed in any period length. The programming and sensing period is predetermined according to system requirements, and may be the same as or different from the display period of each pixel of data.

Figure 3:
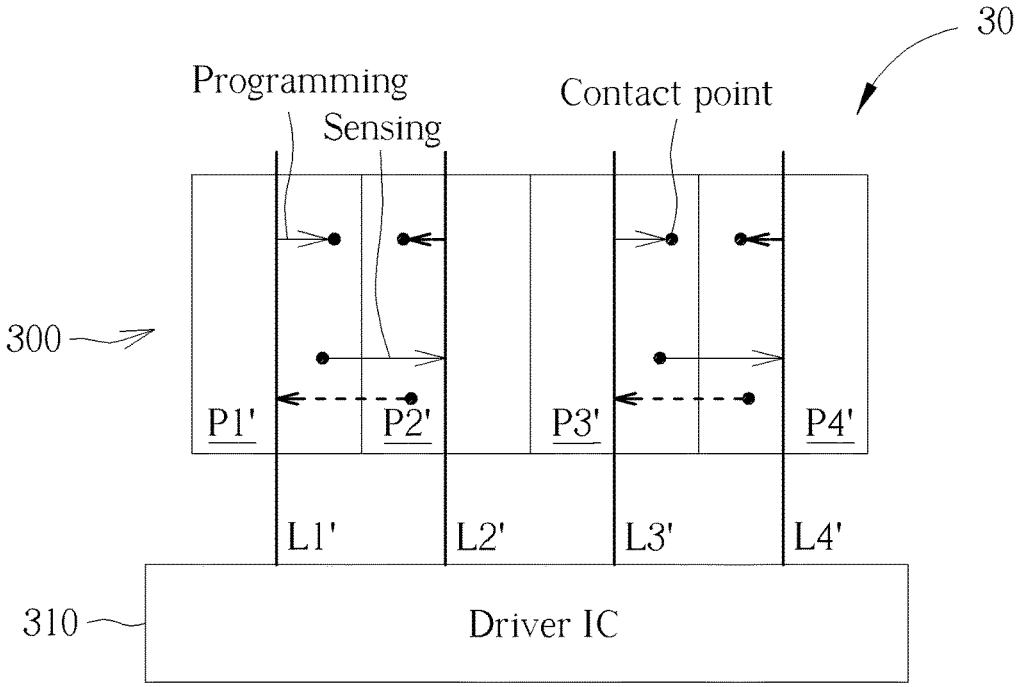
FIG. 3 is a schematic diagram of another OLED display system according to an embodiment of the present invention.

Please refer to FIG. 3, which is a schematic diagram of another OLED display system 30 according to an embodiment of the present invention. As shown in FIG. 3, the OLED display system 30 includes a panel 300 and a driver IC 310. The panel 300 includes a plurality of sub-pixels arranged in a matrix form, and the panel 300 is coupled to the driver IC 310 via a plurality of lines. In FIG. 3, only 4 sub-pixels P1'-P4' and 4 lines L1'-L4' are illustrated for simplicity. Those skilled in the art should realize that there may be hundreds or thousands of columns of sub-pixels and lines in the panel 300. The arrangement of the sub-pixels in the panel 300 is similar to that in the panel 200, but the implementation of line sharing is different.

In the compensation mode, the driver IC 310 may program a device in the sub-pixel P1' via the line L1', and sense the device in the sub-pixel P1' via the line L2'. During another period, the driver IC 310 may program a device in the sub-pixel P2' via the line L2', and sense the device in the sub-pixel P2' via the line L1'. In this manner, every 2 adjacent sub-pixels share two same lines. Due to sharing of the lines, the line number is significantly decreased in comparison with the line number of the panel 100 shown in FIG. 1. In this embodiment, if there are N columns of sub-pixels in the panel 300 and N is an even number, N lines are enough for data display and external compensation operations of the OLED display system 30. Accordingly, the pin count of the driver IC 310 may also be reduced.

More specifically, as shown in FIG. 3, for the sub-pixel P1', an arrow starting from the line L1' to a contact point of the sub-pixel P1' indicates that the line L1' acts as a source line for programming a device in the sub-pixel P1' with a specific voltage signal; and an arrow starting from another contract point of the sub-pixel P1' to the line L2' indicates that the line L2' acts as a sensing line for receiving electrical characteristics of the device in the sub-pixel P1'. For the sub-pixel P2', an arrow starting from the line L2' to a contact point of the sub-pixel P2' indicates that the line L2' acts as a source line for programming a device in the sub-pixel P2' with a specific voltage signal; and an arrow starting from another contact point of the sub-pixel P2' to the line L1' indicates that the line L1' acts as a sensing line for receiving electrical characteristics of the device in the sub-pixel P2'. By the same token, according to directions of the arrows shown in FIG. 3, those skilled in the art can realize the programming and sensing operations in the sub-pixels of the panel 300.

Similarly, each of the lines is used as the source line and sensing line alternately. The programming and sensing operations of the entire panel 300 may be completed in two periods. As shown in FIG. 3, the solid arrow indicates that the programming or sensing operation is performed during the first period, and the dashed arrow indicates that the programming or sensing operation is performed during the second period. Those skilled in the art should be able to realize the programming and sensing operations of the panel 300 according to the above descriptions and the illustrations in FIG. 3, and the operations will not be detailed herein.

Figure 4:
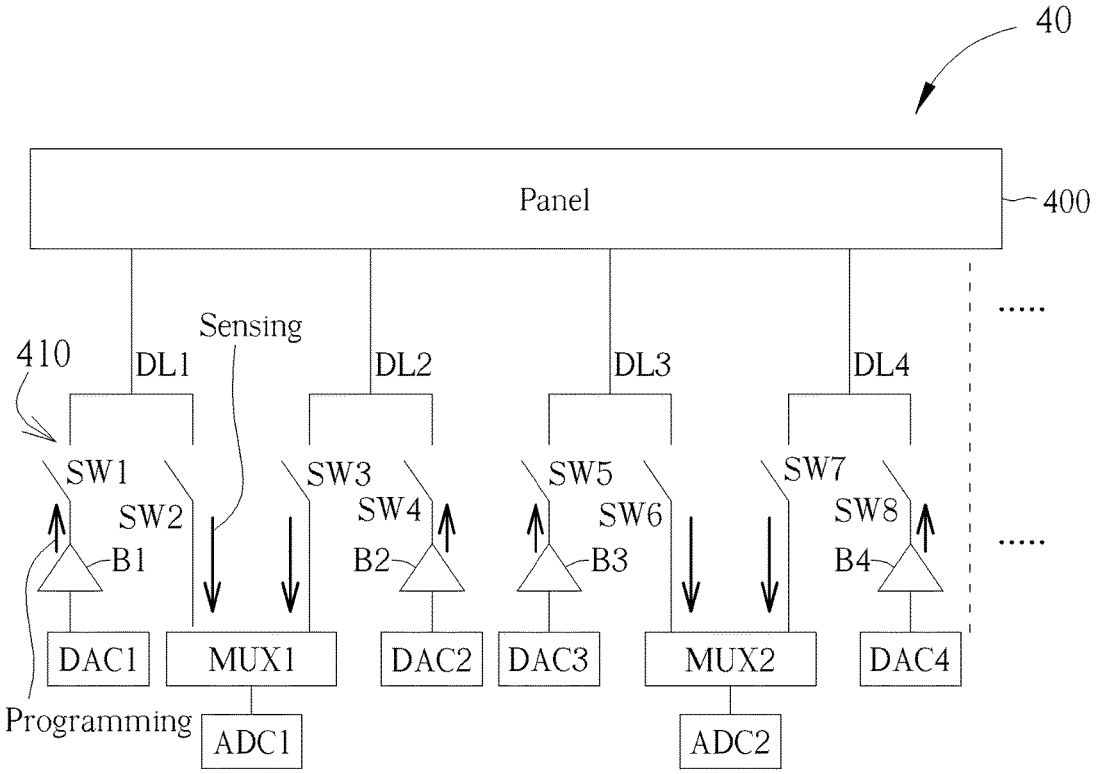
FIG. 4 is a schematic diagram of an OLED display system with a circuit structure of the driver IC according to an embodiment of the present invention.

In order to realize the programming and sensing method described above, a driver IC such as the driver IC 210 or 310 is implemented in a manner described as follows. Please refer to FIG. 4, which is a schematic diagram of an OLED display system 40 with a circuit structure of the driver IC according to an embodiment of the present invention. The OLED display system 40 includes a panel 400 and a driver IC 410, where the detailed circuit structure of the driver IC 410 is illustrated. As shown in FIG. 4, the driver IC 410 includes a plurality of lines, which are coupled to the lines and sub-pixels of the corresponding panel. The driver IC 410 further includes a plurality of DACs and output buffers for programming the devices in the sub-pixels of the panel, and a plurality of ADCs and MUXs for sensing the devices in the sub-pixels of the panel. These circuit elements are coupled to the lines via switches. In FIG. 4, only 4 lines DL1-DL4 and corresponding 4 DACs DAC1-DAC4, 4 output buffers B1-B4, 2 ADCs ADC1-ADC2, 2 MUX MUX1-MUX2 and 8 switches SW1-SW8 are illustrated for simplicity. Those skilled in the art should realize that there may be hundreds or thousands of lines and corresponding circuit elements in the driver IC 410.

In detail, the lines DL1-DL2 and the corresponding circuit elements are taken as an example to describe the circuit structure of the driver IC 410. The DAC DAC1 and the output buffer B1 are coupled to the line DL1. The DAC DAC2 and the output buffer B2 are coupled to the line DL2. The ADC ADC1 is coupled to the lines DL1 and DL2 via the MUX MUX1. In addition, the switch SW1 is coupled between the line DL1 and the output buffer B1. The switch SW2 is coupled between the line DL1 and the MUX MUX1. The switch SW3 is coupled between the line DL2 and the MUX MUX1. The switch SW4 is coupled between the line DL2 and the output buffer B2.

In the display mode, the driver IC 410 sends display data to the panel 400 to display an image. Therefore, the switches SW1 and SW4 may be closed to pass the display data sent via the DACs DAC1-DAC2 and the output buffers B1-B2, while the switches SW2 and SW3 may be open.

In the compensation mode, the driver IC 410 performs external compensation on the panel 400. At this moment, the DACs DAC1-DAC2 and the output buffers B1-B2 may output voltage signals to program the devices on the panel 400. The ADC ADC1 may sense the devices and receive electrical characteristics of the devices from the panel 400. The switches SW1-SW4 and the MUX MUX1 control the driver IC 410 to selectively perform programming or sensing on the devices in the panel 400. Supposing that the line arrangement of the panel 400 is similar to that of the panel 300, the switches SW1-SW4 and the MUX MUX1 may control the driver IC 410 to program a first device in a first sub-pixel of the panel 400 (e.g., the device in the sub-pixel P1' of the panel 300 shown in FIG. 3) via the line DL1 (e.g., the line L1' shown in FIG. 3) and sense the first device via the line DL2 (e.g., the line L2' shown in FIG. 3) during the first period. Subsequently, the switches SW1-SW4 and the MUX MUX1 may control the driver IC 410 to program a second device in a second sub-pixel of the panel 400 (e.g., the device in the sub-pixel P2' of the panel 300 shown in FIG. 3) via the line DL2 (e.g., the line L2' shown in FIG. 3) and sense the second device via the line DL1 (e.g., the line L1' shown in FIG. 3) during the second period. Note that the disposition of circuit elements shown in FIG. 4 is also applicable to the arrangement of the devices and sub-pixels in the panel 200 shown in FIG. 2, to perform programming and sensing operations in a similar manner. In such a situation, the second device may be programmed via the line DL2 and sensed via the line DL3 (e.g., the line L3 shown in FIG. 2).

Figure 5:
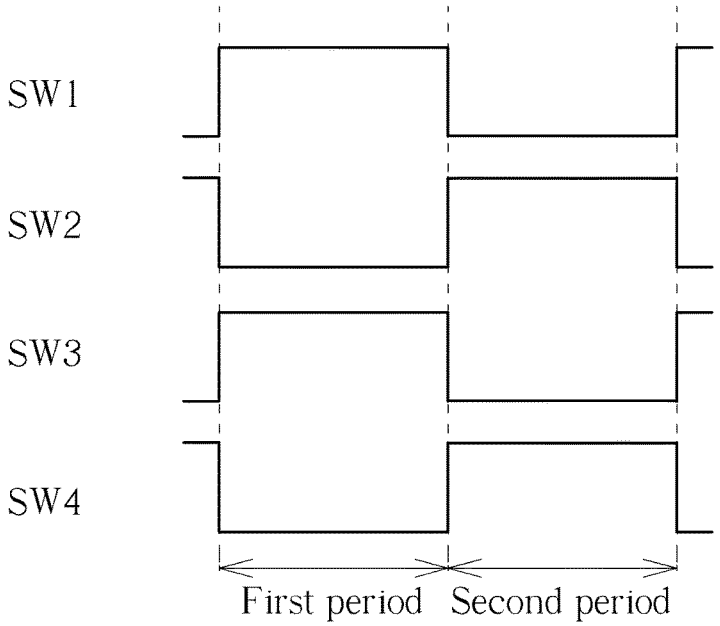
FIG. 5 is a waveform diagram of the switches shown in FIG. 4.

FIG. 5 illustrates the waveforms of the switches SW1-SW4 shown in FIG. 4. Suppose that a control signal in a higher level controls a switch to be closed, and a control signal in a lower level controls a switch to be open. During the first period, the switches SW1 and SW3 are closed and the switches SW2 and SW4 are open. Therefore, the line DL1, coupled to the output buffer B1, acts as a source line allowing the DAC DAC1 and the output buffer B1 to program a device in a sub-pixel of the panel 400. The line DL2, coupled to the MUX MUX1, acts as a sensing line allowing the ADC ADC1 to receive electrical characteristics of the device in the sub-pixel. During the second period, the switches SW2 and SW4 are closed and the switches SW1 and SW3 are open. Therefore, the line DL1, coupled to the MUX MUX1, acts as a sensing line allowing the ADC ADC1 to receive electrical characteristics of a device in a sub-pixel of the panel 400. The line DL2, coupled to the output buffer B2, acts as a source line allowing the DAC DAC2 and the output buffer B2 to program the device in the sub-pixel.

Please note that the operations of the switches SW1-SW4 may be analogous to the switches SW5-SW8 and other switches in the driver IC 410. In such a situation, the lines of the driver IC 410 may be separated into two groups of lines, and each line among the first group of lines is adjacent to a line among the second group of lines. During the first period, the first group of lines, i.e., the odd columns of lines such as DL1 and DL3, may act as source lines for programming the devices in a first group of sub-pixels (the odd columns of sub-pixels), and the second group of lines, i.e., the even columns of lines such as DL2 and DL4, may act as sensing lines for sensing the devices in the first group of sub-pixels. During the second period, the first group of lines may act as sensing lines for sensing the devices in a second group of sub-pixels (the even columns of sub-pixels), and the second group of lines may act as source lines for programming the devices in the second group of sub-pixels. This allows the programming and sensing operations of the entire panel to be completed in two periods.

Further note that in the present invention, the driver IC processes digital data and outputs analog data after conversions of the DACs, and also receives sensing data from the panel after conversions of the ADCs. Therefore, the DACs and ADCs are necessary in the driver IC. However, the circuit structure of the driver IC 410 shown in FIG. 4 is only one of various possible embodiments of the present invention. For example, in another embodiment, the output buffer may be integrated in the corresponding DAC. In a further embodiment, the switches SW2 and SW3 may be integrated in the MUX MUX1, and the switches SW6 and SW7 may be integrated in the MUX MUX2. In addition, the switches may be implemented by any method such as a single transistor or a transmission gate, which is not limited herein.

For the external compensation in the sub-pixels of the panel, the devices to be sensed may be the OLEDs or thin-film transistors (TFTs). The driver IC may compensate the parameters of the OLEDs and the TFTs by generating the display data based on the sensing results of these devices. Please refer to FIGS. 6A-6D, which are schematic diagrams of detailed programming and sensing operations of the sub-pixels shown in FIG. 2. In FIGS. 6A-6D, the sub-pixels P1-P3 and corresponding lines L1-L4 are illustrated, where the lines L1-L4 are coupled to a driver IC (not illustrated). Each of the sub-pixels P1-P3 includes an OLED LED1, a driving TFT T1, a capacitor and several control TFTs acting as switches. The sub-pixels P1-P3 have a P-type structure, where the driving TFT T1 is a P-type metal-oxide semiconductor field-effect transistor (PMOSFET).

Figure 6A:
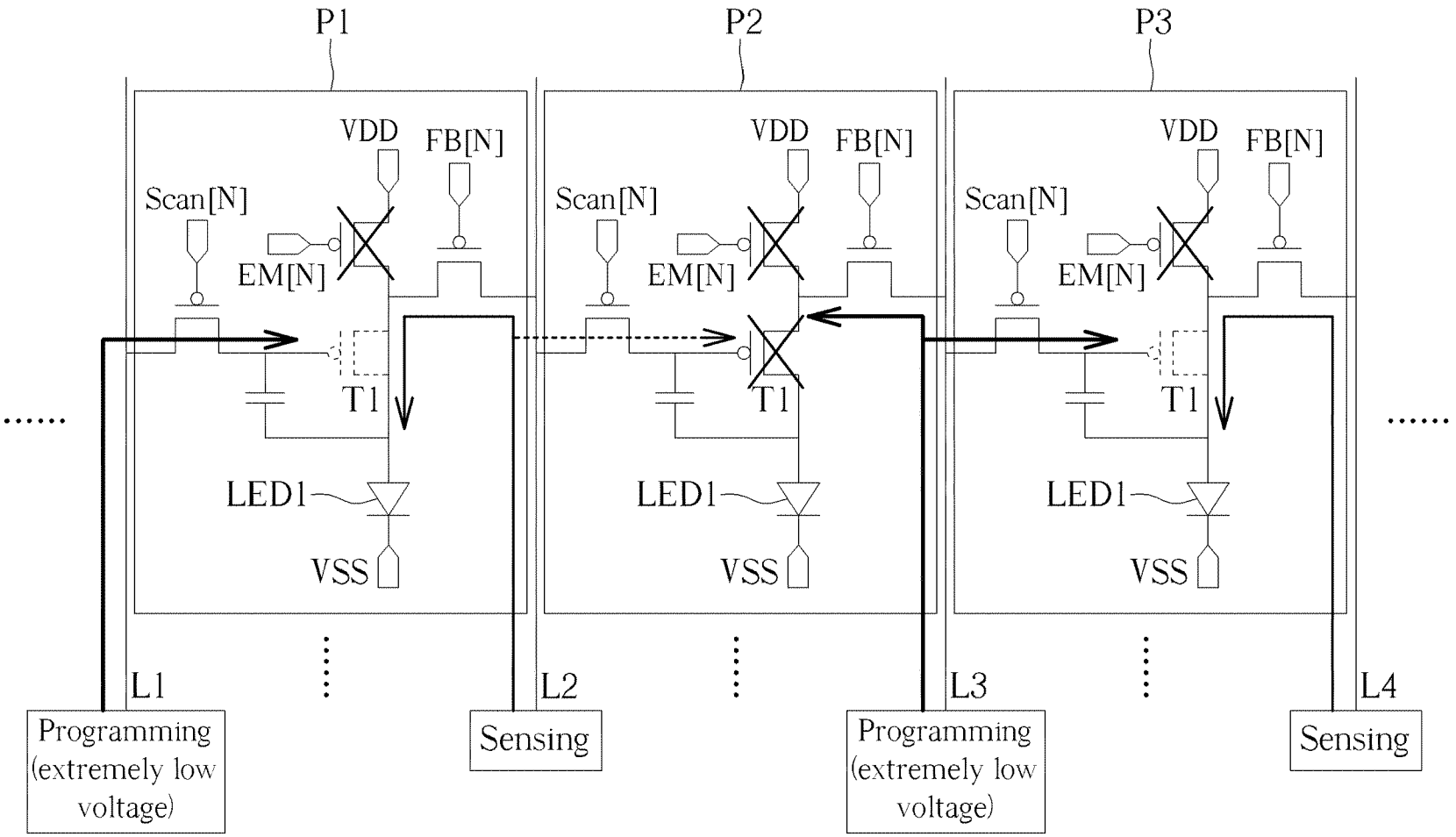
FIGS. 6A-6D are schematic diagrams of detailed programming and sensing operations of the sub-pixels shown in FIG. 2.

As shown in FIG. 6A, the driver IC performs sensing on the OLED LED1 via the lines L2 and L4, by programming the sub-pixels P1 and P3 with an extremely low voltage via the lines L1 and L3. In this embodiment, the sensing operation is performed on the OLED LED1 in the sub-pixels P1 and P3. In detail, in the compensation mode, the control signals Scan[N] and FB[N] turn on the corresponding control TFTs and the control signal EM[N] turns off the corresponding control TFT. Therefore, the extremely low voltage from the lines L1 and L3, which is outputted to the gate terminal of the driving TFT T1, turns on the driving TFT T1 and makes the driving TFT T1 operate in the linear region, where the driving TFT T1 may be regarded as a fully closed switch. In such a situation, the sensing signal from the lines L2 and L4 may enter the OLED LED1 in the sub-pixels P1 and P3 via the driving TFT T1, in order to obtain the electrical characteristics of the OLED LED1. For example, the driver IC may generate a voltage signal on the sensing line L2 and sense the current flowing through the OLED LED1, or generate a current signal on the sensing line L2 and detect the voltage of the OLED LED1.

Please note that the sensing operation may generate a higher voltage on the sensing lines, e.g., the lines L2 and L4, and the higher voltage may turn off the driving TFT in the sub-pixels adjacent to the sensed sub-pixels, e.g., the sub-pixel P2. In addition, the sensing signal on the sensing lines may be isolated by the gate terminal of the driving TFT and the capacitor in the non-sensed sub-pixels, which may not interfere with the sensing operations of the sensed sub-pixels. For example, in the sub-pixel P2 shown in FIG. 6A, the sensing signal is outputted to the gate terminal of the driving TFT T1 and the capacitor, which may not influence the sensing results. The driving TFT T1 is turned off by the higher voltage, so that the programming signal from the line L3 may not enter the OLED LED1 of the sub-pixel P2. As shown in FIGS. 6A-6D, a cross mark on a TFT indicates that the TFT is open or turned off. Therefore, the sub-pixel P2 may isolate the programming and sensing operations of the sub-pixels P1 and P3. This prevents the operations of different sub-pixels from being interfered with by each other.

In an exemplary embodiment of the present invention, the input voltage VDD may be 8V and the ground voltage VSS may be 0V. The programming signal from the lines L1 and L3 may have an extremely low voltage equal to 0V, which makes the driving TFT in the sub-pixels P1 and P3 operate in the linear region. The voltage of the sensing signal on the lines L2 and L4 may be equal to 6V. In this embodiment, the programming and sensing operations are performed on the OLED LED1 in the odd columns of sub-pixels.

Figure 6B:
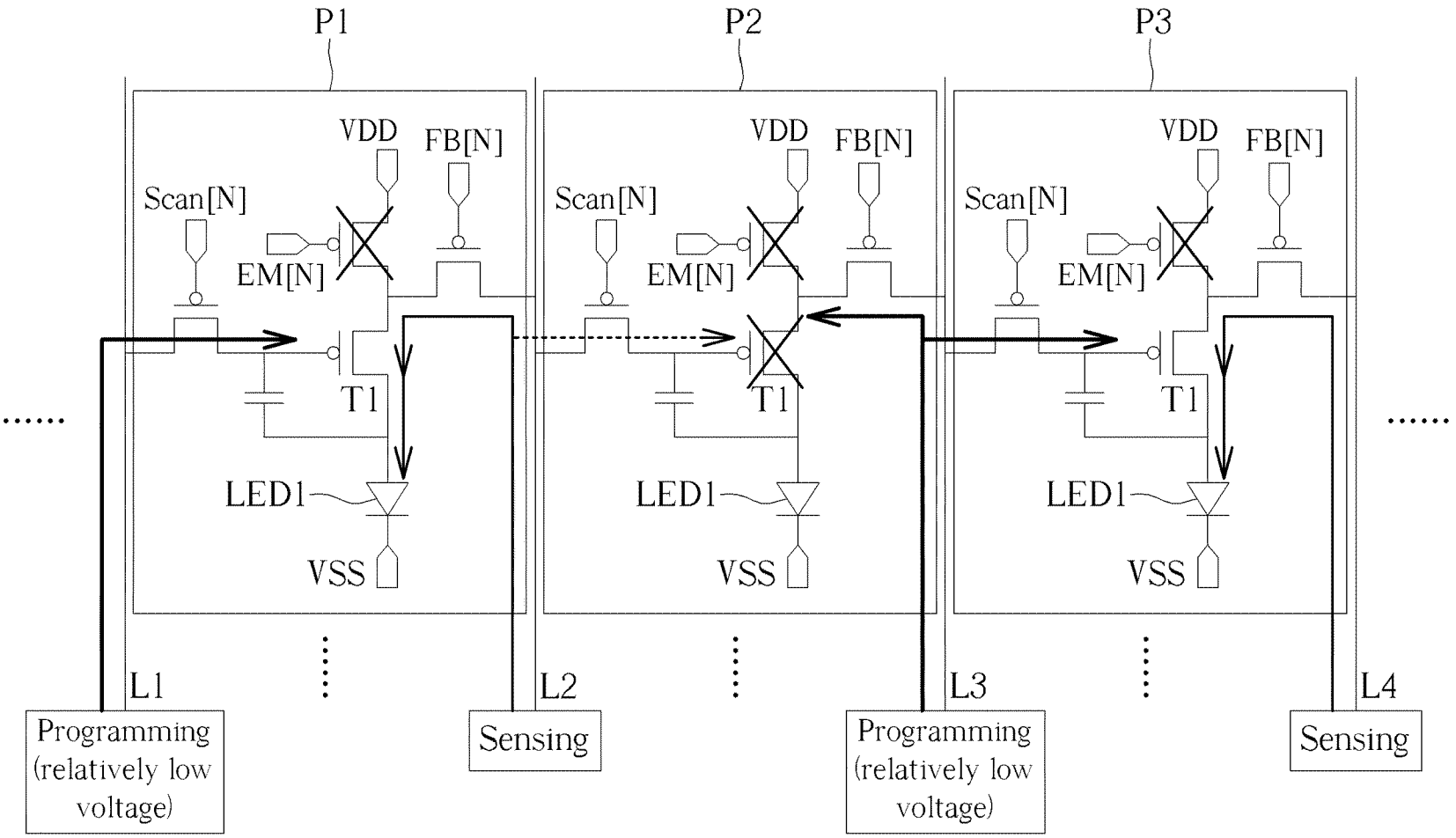

As shown in FIG. 6B, the driver IC performs sensing on the driving TFT T1 via the lines L2 and L4, by programming the sub-pixels P1 and P3 with a relatively low voltage via the lines L1 and L3. In this embodiment, the sensing operation is performed on the driving TFT T1 in the sub-pixels P1 and P3. In detail, in the compensation mode, the control signals Scan[N] and FB[N] turn on the corresponding control TFTs and the control signal EM[N] turns off the corresponding control TFT. Therefore, the relatively low voltage from the lines L1 and L3, which is outputted to the gate terminal of the driving TFT T1, turns on the driving TFT T1 and makes the driving TFT T1 operate in the saturation region. In such a situation, the sensing signal of the lines L2 and L4 may enter the OLED LED1 in the sub-pixels P1 and P3 via the driving TFT T1, and the sensing voltage and current may follow the current-voltage characteristics of the MOSFET operating in the saturation region. Therefore, the driver IC may obtain the electrical characteristics of the driving TFT T1 and the OLED LED1. By subtracting the OLED parts obtained in the above embodiment as illustrated in FIG. 6A, the driver IC may obtain the electrical characteristics of the driving TFT T1.

Similarly, in the sub-pixel P2 shown in FIG. 6B, the higher voltage of the sensing signal is outputted to the gate terminal of the driving TFT T1 and the capacitor, which may not influence the sensing results. The driving TFT T1 is turned off by the higher voltage, so that the programming signal from the line L3 may not enter the OLED LED1 of the sub-pixel P2. Therefore, the sub-pixel P2 may isolate the programming and sensing operations of the sub-pixels P1 and P3. This prevents the operations of different sub-pixels from being interfered with by each other.

In an exemplary embodiment of the present invention, the input voltage VDD may be 8V and the ground voltage VSS may be 0V. The programming signal from the lines L1 and L3 may have a relatively low voltage equal to 4V, which makes the driving TFT in the sub-pixels P1 and P3 operate in the saturation region. The voltage of the sensing signal on the lines L2 and L4 may be equal to 6V. In this embodiment, the programming and sensing operations are performed on the driving TFT T1 and the OLED LED1 in the odd columns of sub-pixels, and the information related to the driving TFT T1 is obtained after the OLED parts are subtracted.

Figure 6C:
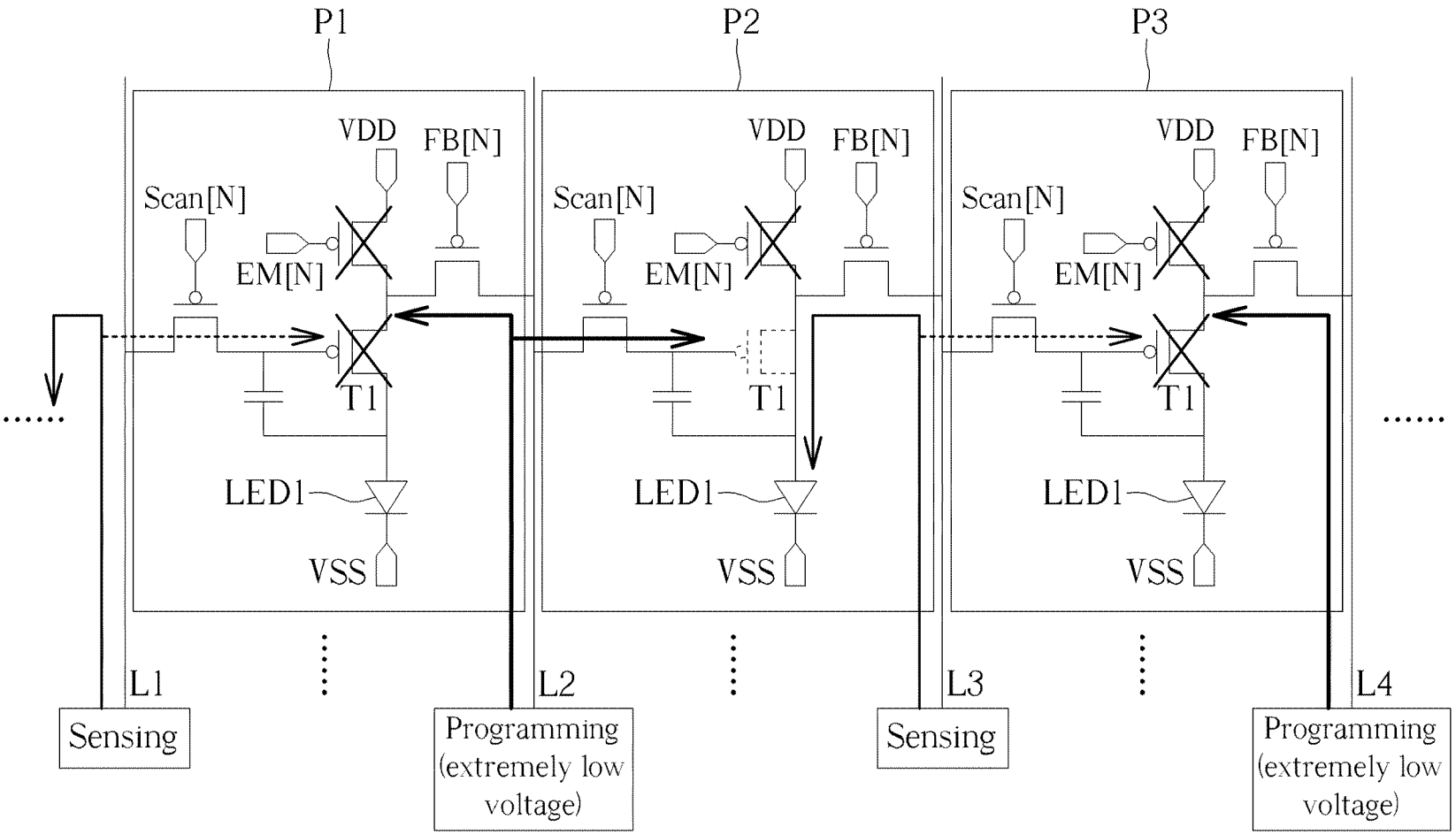

As shown in FIG. 6C, the driver IC performs sensing on the OLED LED1 via the line L3, by programming the sub-pixel P2 with an extremely low voltage via the line L2. In this embodiment, the sensing operation is performed on the OLED LED1 in the sub-pixel P2. More specifically, the programming and sensing operations are performed on the OLED LED1 in the even columns of sub-pixels. In contrast to the embodiment shown in FIG. 6A, the lines play different roles in the embodiment shown in FIG. 6C; that is, the odd columns of lines, e.g., L1, L3 . . . , act as sensing lines for receiving the electrical characteristics of the OLED LED1 in the even columns of sub-pixels, and the even columns of lines, e.g., L2, L4 . . . , act as source lines for programming the even columns of sub-pixels. Those skilled in the art may realize the detailed programming and sensing operations of the OLED LED1 in the even columns of sub-pixels according to the above descriptions and the illustrations of FIG. 6C; these will not be narrated herein.

Figure 6D:
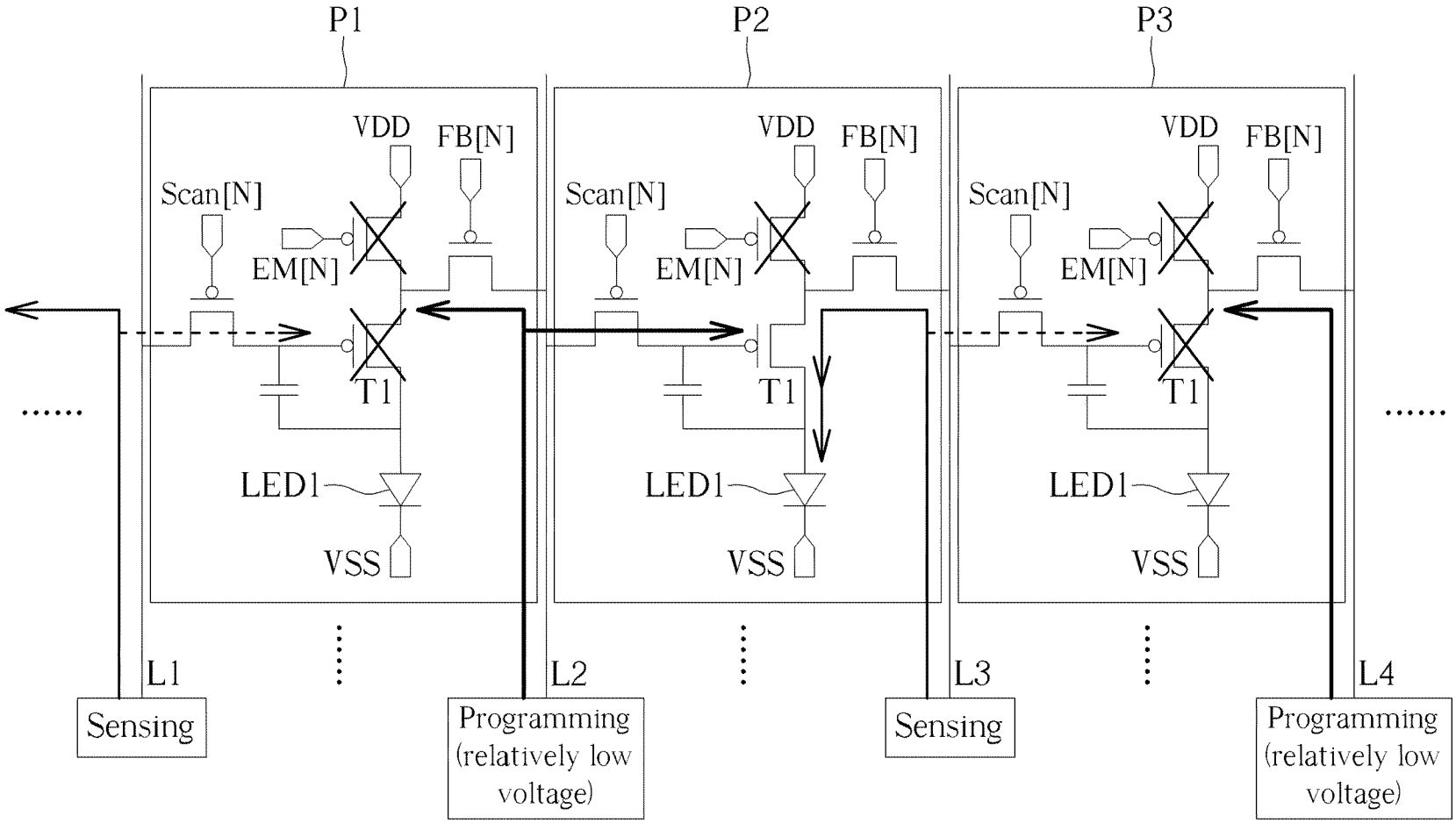

As shown in FIG. 6D, the driver IC performs sensing on the driving TFT T1 via the line L3, by programming the sub-pixel P2 with a relatively low voltage via the line L2. In this embodiment, the sensing operation is performed on the driving TFT T1 in the sub-pixel P2. More specifically, the programming and sensing operations are performed on the driving TFT T1 in the even columns of sub-pixels. In contrast to the embodiment shown in FIG. 6B, the lines play different roles in the embodiment shown in FIG. 6D; that is, the odd columns of lines, e.g., L1, L3 . . . , act as sensing lines for receiving the electrical characteristics of the driving TFT T1 in the even columns of sub-pixels, and the even columns of lines, e.g., L2, L4 . . . , act as source lines for programming the even columns of sub-pixels. Those skilled in the art may realize the detailed programming and sensing operations of the driving TFT T1 in the even columns of sub-pixels according to the above descriptions and the illustrations of FIG. 6D; these will not be narrated herein.

Please note that the programming and sensing operations of the present invention is also applicable to a sub-pixel having an N-type structure, as described in the following paragraphs.

Please refer to FIGS. 7A-7D, which are schematic diagrams of detailed programming and sensing operations of the sub-pixels shown in FIG. 2. In FIGS. 7A-7D, the sub-pixels P1-P3 and corresponding lines L1-L4 are illustrated, where the lines L1-L4 are coupled to a driver IC (not illustrated). Each of the sub-pixels P1-P3 includes an OLED LED2, a driving TFT T2, a capacitor and several control TFTs acting as switches. The sub-pixels P1-P3 have an N-type structure, where the driving TFT T2 is an N-type metal-oxide semiconductor field-effect transistor (NMOS-FET).

Figure 7A:
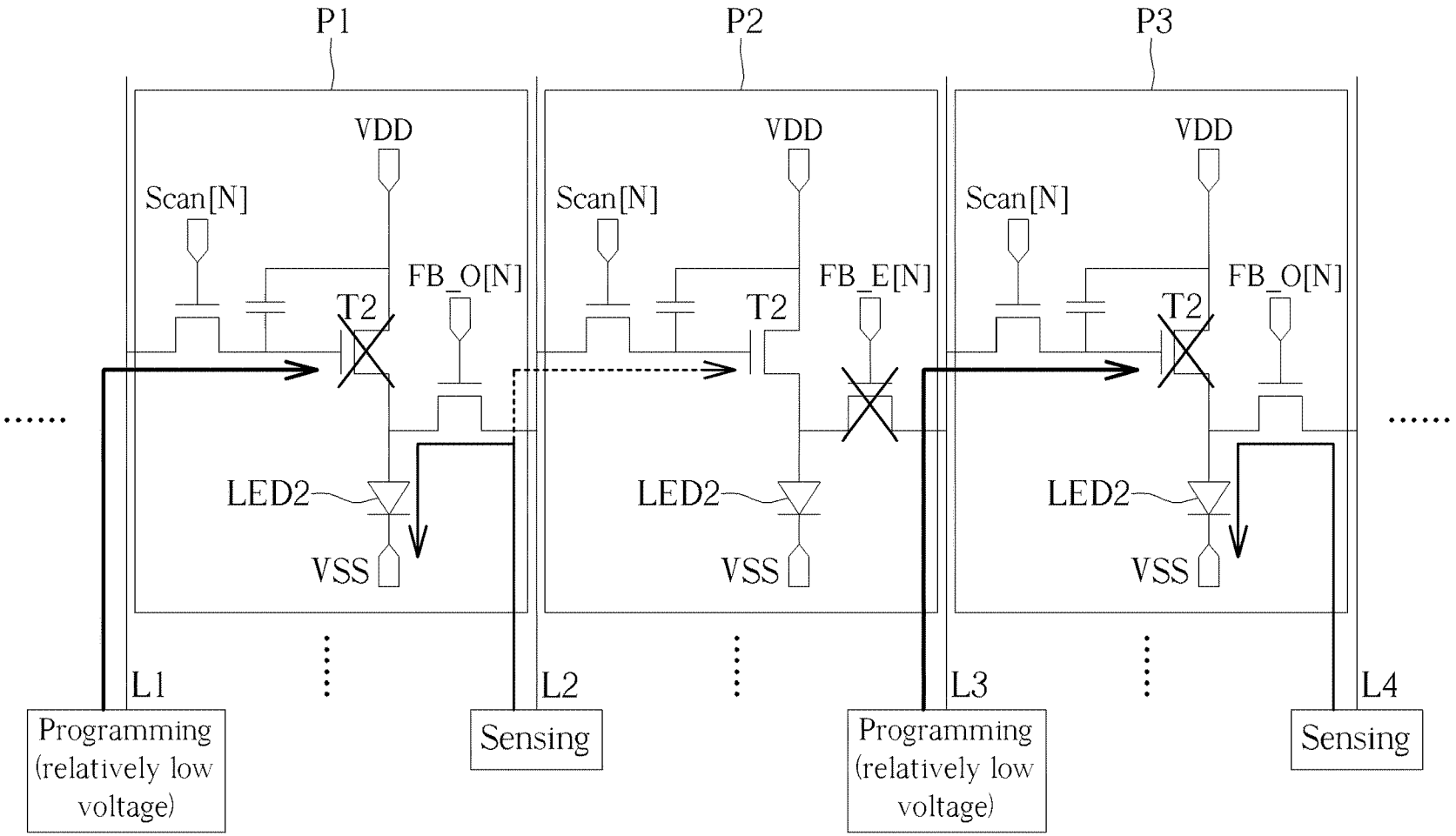
FIGS. 7A-7D are schematic diagrams of detailed programming and sensing operations of the sub-pixels shown in FIG. 2.

As shown in FIG. 7A, the driver IC performs sensing on the OLED LED2 via the lines L2 and L4, by programming the sub-pixels P1 and P3 with a relatively low voltage via the lines L1 and L3. In this embodiment, the sensing operation is performed on the OLED LED2 in the sub-pixels P1 and P3. In detail, in the compensation mode, the control signals Scan[N] and FB_O[N] turn on the corresponding control TFTs and the control signal FB_E[N] turns off the corresponding control TFT. Therefore, the relatively low voltage from the lines L1 and L3, which is outputted to the gate terminal of the driving TFT T2, turns off the driving TFT T2 and makes the driving TFT T2 operate in the cut-off region, where the driving TFT T2 may be regarded as an open switch. In such a situation, the sensing signal from the lines L2 and L4 may enter the OLED LED2 in the sub-pixels P1 and P3 without any interference from the driving TFT T2, in order to obtain the electrical characteristics of the OLED LED2.

Please note that the sensing operation may generate a higher voltage on the sensing lines, e.g., the lines L2 and L4, and the higher voltage may turn on the driving TFT in the sub-pixels adjacent to the sensed sub-pixels, e.g., the sub-pixel P2. However, the control signal FB_E[N] may turn off the corresponding control TFT, which prevents the programming signal from entering the non-sensed sub-pixels. In addition, the sensing signal on the sensing lines may be isolated by the gate terminal of the driving TFT and the capacitor in the non-sensed sub-pixels, which may not interfere with the sensing operations of the sensed sub-pixels. For example, in the sub-pixel P2 shown in FIG. 7A, the sensing signal is outputted to the gate terminal of the driving TFT T2 and the capacitor, which may not influence the sensing results. The rightest control TFT of the sub-pixel P2 is turned off by the control signal FB_E[N], so that the programming signal from the line L3 may not enter the OLED LED2 of the sub-pixel P2. Similarly, as shown in FIGS. 7A-7D, a cross mark on a TFT indicates that the TFT is open or turned off. Therefore, the sub-pixel P2 may isolate the programming and sensing operations of the sub-pixels P1 and P3. This prevents the operations of different sub-pixels from being interfered with by each other.

In an exemplary embodiment of the present invention, the input voltage VDD may be 8V and the ground voltage VSS may be 0V. The programming signal from the lines L1 and L3 may have a relatively low voltage equal to 3V, which turns off the driving TFT in the sub-pixels P1 and P3. The voltage of the sensing signal on the lines L2 and L4 may be equal to 5V. In this embodiment, the programming and sensing operations are performed on the OLED LED2 in the odd columns of sub-pixels.

Figure 7B:
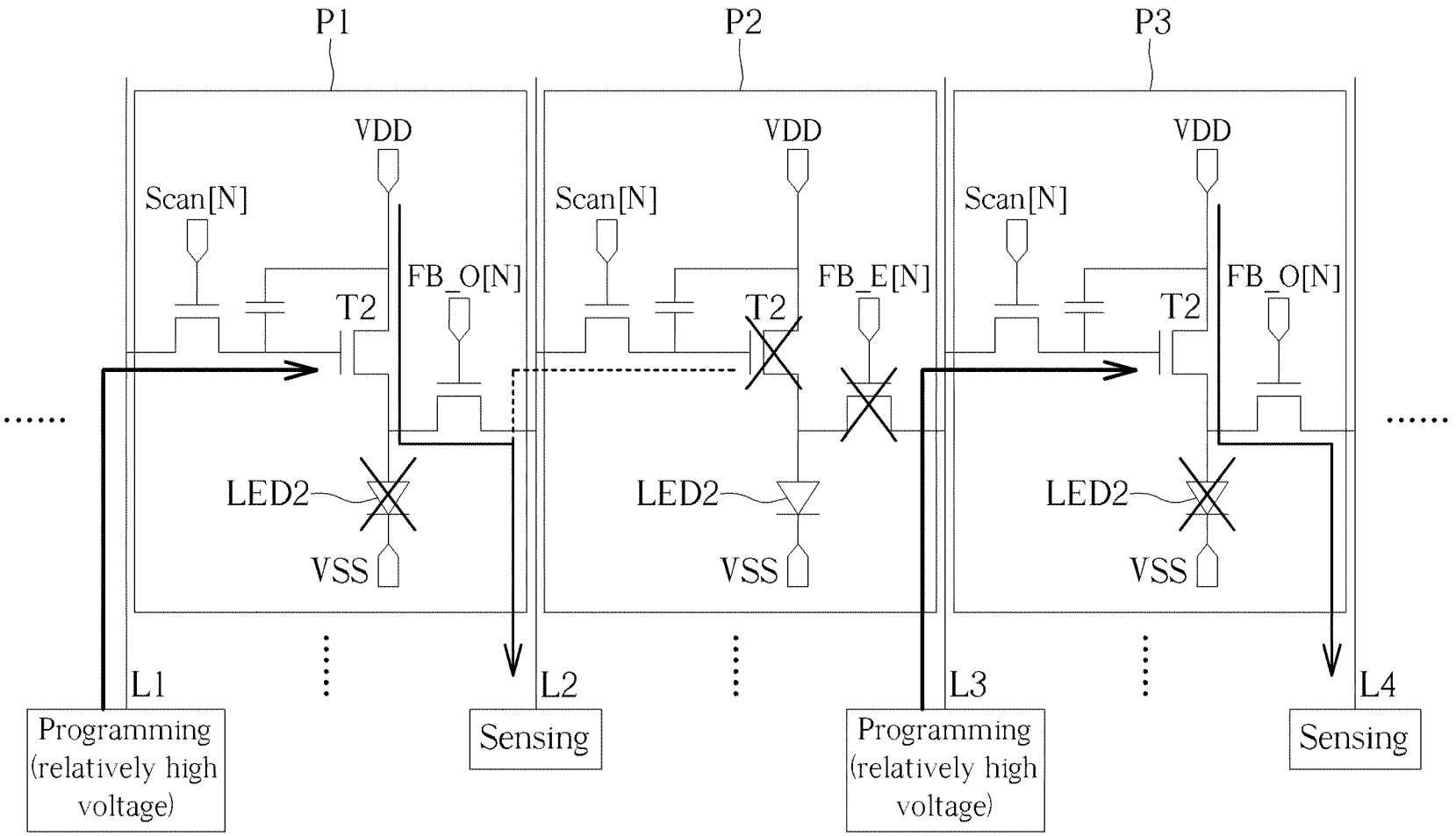

As shown in FIG. 7B, the driver IC performs sensing on the driving TFT T2 via the lines L2 and L4, by programming the sub-pixels P1 and P3 with a relatively high voltage via the lines L1 and L3. In this embodiment, the sensing operation is performed on the driving TFT T2 in the sub-pixels P1 and P3. In detail, in the compensation mode, the control signals Scan[N] and FB_O[N] turn on the corresponding control TFTs and the control signal FB_E[N] turns off the corresponding control TFT. Therefore, the relatively high voltage from the lines L1 and L3, which is outputted to the gate terminal of the driving TFT T2, turns on the driving TFT T2 and makes the driving TFT T2 operate in the saturation region. In such a situation, the sensing signal of the lines L2 and L4 may enter the driving TFT T2 in the sub-pixels P1 and P3, and the sensing voltage and current may follow the current-voltage characteristics of the MOSFET operating in the saturation region. Therefore, the driver IC may obtain the electrical characteristics of the driving TFT T2.

Please note that the sensing operation may generate a lower voltage on the sensing lines, e.g., the lines L2 and L4, and the lower voltage may turn off the driving TFT in the sub-pixels adjacent to the sensed sub-pixels, e.g., the sub-pixel P2. In addition, the sensing signal on the sensing lines may be isolated by the gate terminal of the driving TFT and the capacitor in the non-sensed sub-pixels, which may not interfere with the sensing operations of the sensed sub-pixels. For example, in the sub-pixel P2 shown in FIG. 7B, the lower voltage of the sensing signal is outputted to the gate terminal of the driving TFT T2 and the capacitor, which may not influence the sensing results. The driving TFT T2 is turned off by the lower voltage, and the control TFT of the control signal FB_E[N] is also turned off, so that the programming signal from the line L3 may not enter the sub-pixel P2. Therefore, the sub-pixel P2 may isolate the programming and sensing operations of the sub-pixels P1 and P3. This prevents the operations of different sub-pixels from being interfered with by each other.

In an exemplary embodiment of the present invention, the input voltage VDD may be 8V and the ground voltage VSS may be 0V. The programming signal from the lines L1 and L3 may have a relatively high voltage equal to 5V, which makes the driving TFT in the sub-pixels P1 and P3 operate in the saturation region. The voltage of the sensing signal on the lines L2 and L4 may be equal to 3V. In this embodiment, the programming and sensing operations are performed on the driving TFT T2 in the odd columns of sub-pixels.

Figure 7C:
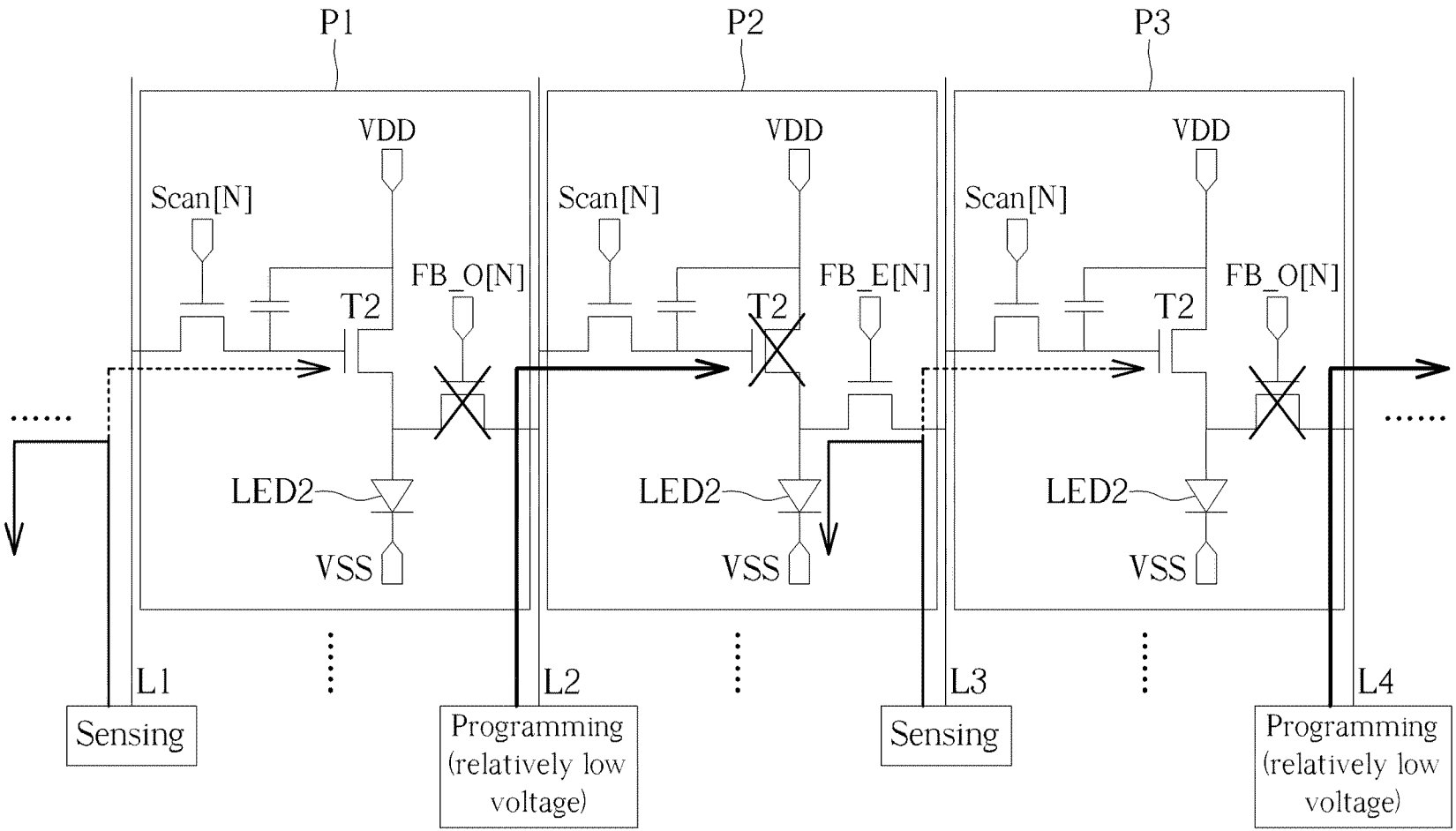

As shown in FIG. 7C, the driver IC performs sensing on the OLED LED2 via the line L3, by programming the sub-pixel P2 with a relatively low voltage via the line L2. In this embodiment, the sensing operation is performed on the OLED LED2 in the sub-pixel P2. More specifically, the programming and sensing operations are performed on the OLED LED2 in the even columns of sub-pixels. In contrast to the embodiment shown in FIG. 7A, the lines play different roles in the embodiment shown in FIG. 7C; that is, the odd columns of lines, e.g., L1, L3 . . . , act as sensing lines for receiving the electrical characteristics of the OLED LED2 in the even columns of sub-pixels, and the even columns of lines, e.g., L2, L4 . . . , act as source lines for programming the even columns of sub-pixels. Those skilled in the art may realize the detailed programming and sensing operations of the OLED LED2 in the even columns of sub-pixels according to the above descriptions and the illustrations of FIG. 7C; these will not be narrated herein.

Figure 7D:
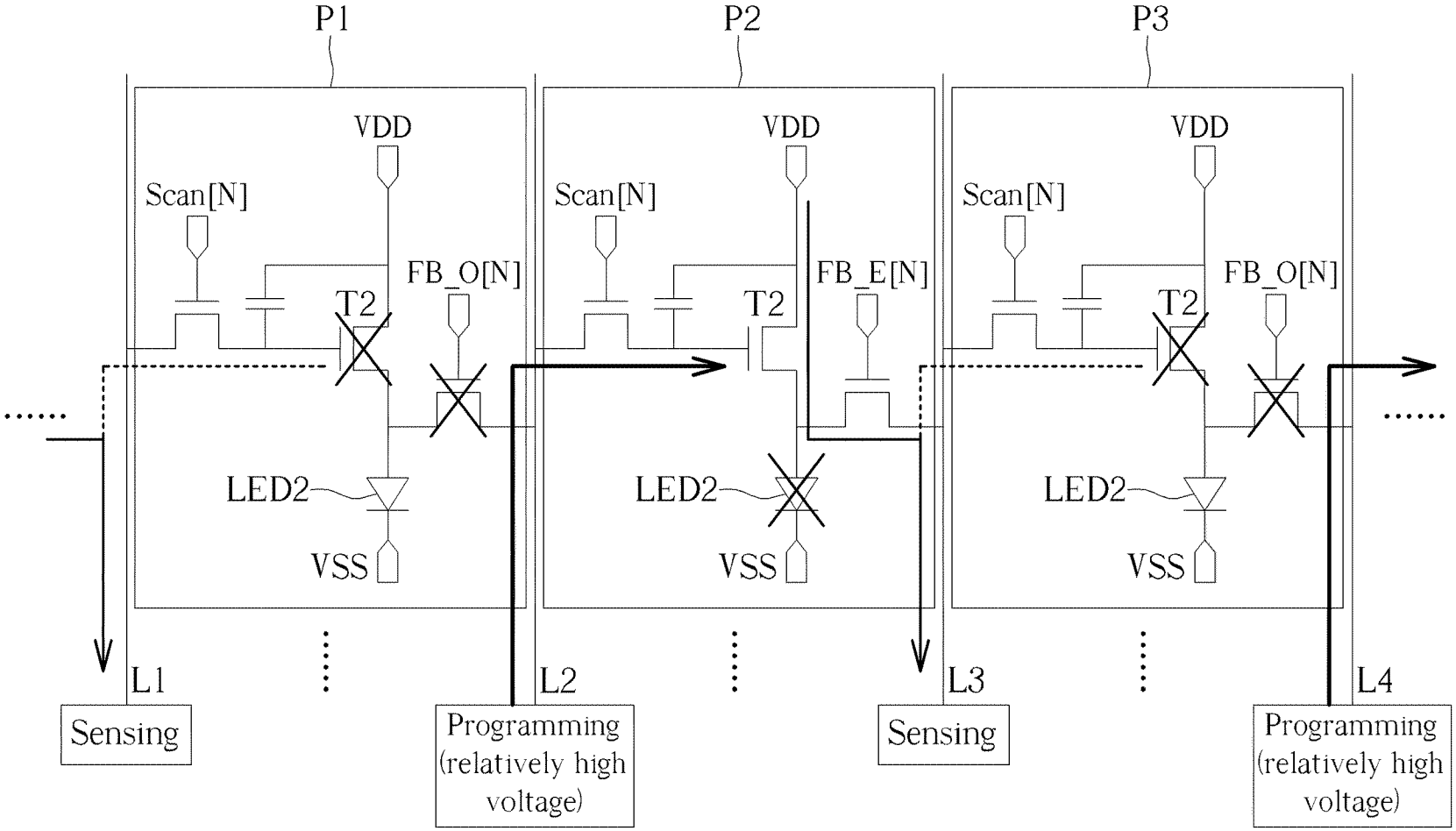

As shown in FIG. 7D, the driver IC performs sensing on the driving TFT T2 via the line L3, by programming the sub-pixel P2 with a relatively high voltage via the line L2. In this embodiment, the sensing operation is performed on the driving TFT T2 in the sub-pixel P2. More specifically, the programming and sensing operations are performed on the driving TFT T2 in the even columns of sub-pixels. In contrast to the embodiment shown in FIG. 7B, the lines play different roles in the embodiment shown in FIG. 7D; that is, the odd columns of lines, e.g., L1, L3 . . . , act as sensing lines for receiving the electrical characteristics of the driving TFT T2 in the even columns of sub-pixels, and the even columns of lines, e.g., L2, L4 . . . , act as source lines for programming the even columns of sub-pixels. Those skilled in the art may realize the detailed programming and sensing operations of the driving TFT T2 in the even columns of sub-pixels according to the above descriptions and the illustrations of FIG. 7D; these will not be narrated herein.

Figure 8:
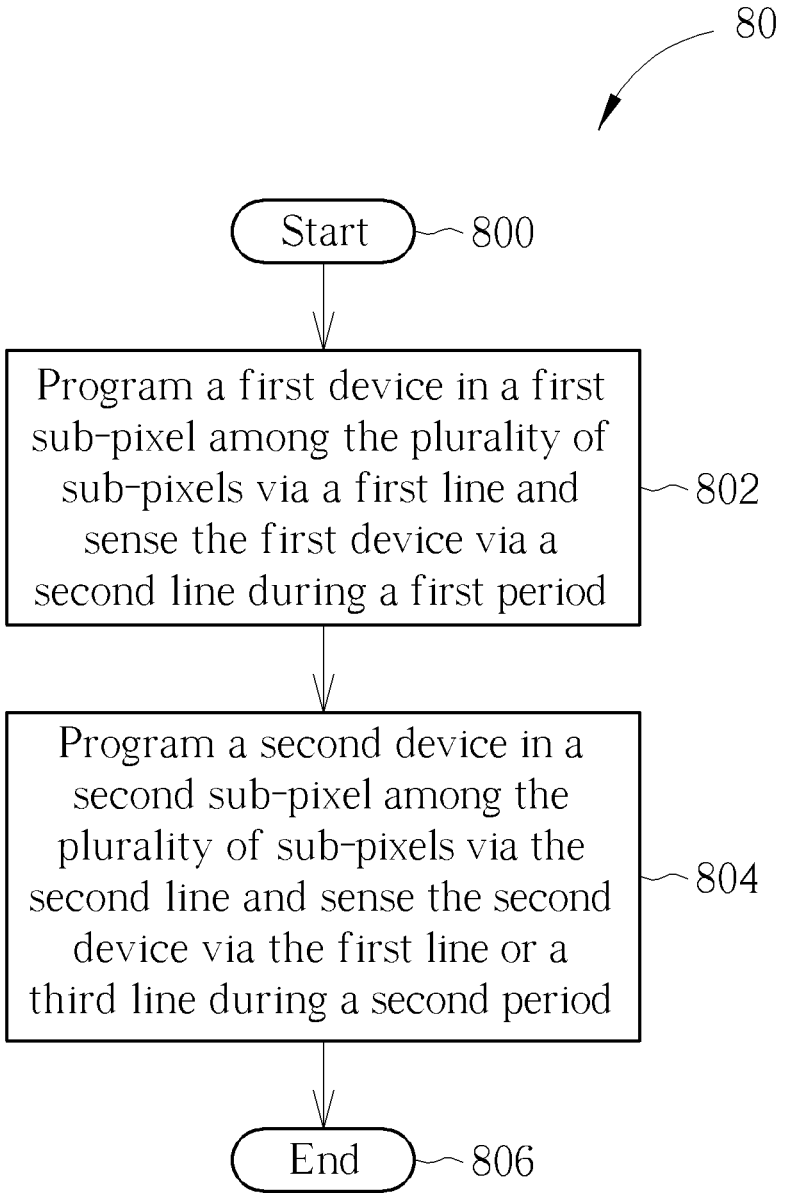
FIG. 8 is a schematic diagram of an external compensation process according to an embodiment of the present invention.

The abovementioned programming and sensing operations of the OLED display system may be summarized into an external compensation process 80, as shown in FIG. 8. The external compensation process 80, which may be performed by the driver IC, includes the following steps:

Step 800: Start.

Step 802: Program a first device in a first sub-pixel among the plurality of sub-pixels via a first line and sense the first device via a second line during a first period.

Step 804: Program a second device in a second sub-pixel among the plurality of sub-pixels via the second line and sense the second device via the first line or a third line during a second period.

Step 806: End.

The detailed operations and alternations of the external compensation process 80 are illustrated in the above descriptions, and will not be narrated herein.

To sum up, the present invention provides an external compensation method for a panel and a driver IC performing the external compensation method on the panel. According to the external compensation method, the columns of lines may be used as source lines or sensing lines and shared by adjacent sub-pixels. The devices in odd columns of sub-pixels and even columns of sub-pixels are programmed and sensed alternately. In other words, the devices in odd columns of sub-pixels may be programmed and sensed during the first period and the devices in even columns of sub-pixels may be programmed and sensed during the second period. In the driver IC, the ADC may be shared by two adjacent lines; this decreases the number of ADCs used in the driver IC and thereby decreases the cost of the driver IC. In addition, the external compensation method is applicable to sub-pixels having any structure such as a P-type structure or N-type structure. By the external compensation method of the present invention, if there are N columns of sub-pixels in the panel, N or N+1 lines are enough for data display and external compensation operations, and the pin count of the driver IC may also be reduced accordingly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An external compensation method for devices in a panel, the panel comprising a plurality of sub-pixels, the external compensation method comprising:

programming a first device in a first sub-pixel among the plurality of sub-pixels by outputting a first voltage or current signal to a first source or sensing line and sensing the first device via a second source or sensing line in response to the operation of programming the first device during a first period; and programming a second device in a second sub-pixel among the plurality of sub-pixels by outputting a second voltage or current signal to the second source or sensing line and sensing the second device via the first source or sensing line or a third source or sensing line in response to the operation of programming the second device during a second period;

wherein each of the first device and the second device is an organic light-emitting diode (OLED) or a thin-film transistor (TFT) in the panel.

2. The external compensation method of claim 1, wherein the second sub-pixel is adjacent to the first sub-pixel.

3. The external compensation method of claim 1, wherein the plurality of sub-pixels are separated into a first group of sub-pixels and a second group of sub-pixels, and the devices in the first group of sub-pixels are programmed and sensed during the first period and the devices in the second group of sub-pixels are programmed and sensed during the second period.

4. The external compensation method of claim 3, wherein the first group of sub-pixels comprises odd columns of sub-pixels among the plurality of sub-pixels, and the second group of sub-pixels comprises even columns of sub-pixels among the plurality of sub-pixels.

5. A driver integrated circuit (IC) for a panel, for performing external compensation on the panel, the driver IC comprising:

a plurality of lines for connecting to the panel, the plurality of lines comprising a first line and a second line;

a first digital to analog converter (DAC) and a first output buffer, coupled to the first line;

a second DAC and a second output buffer, coupled to the second line;

a multiplexer (MUX);

an analog to digital converter (ADC), coupled to the first line and the second line via the MUX;

a first switch, coupled between the first line and the first output buffer; and a fourth switch, coupled between the second line and the second output buffer.

6. The driver IC of claim 5, further comprising:

a second switch, coupled between the first line and the MUX; and a third switch, coupled between the second line and the MUX;

wherein the first switch, the second switch, the third switch, the fourth switch and the MUX control the driver IC to selectively program a first device in a first sub-pixel of the panel via the first line and sense the first device via the second line, or program a second device in a second sub-pixel of the panel via the second line and sense the second device via the first line or a third line.

7. The driver IC of claim 5, wherein the plurality of lines are separated into a first group of lines and a second group of lines, and each line among the first group of lines is adjacent to a line among the second group of lines.

8. The driver IC of claim 7, wherein the driver IC programs a plurality of first devices in the panel via the first group of lines and senses the plurality of first devices via the second group of lines during a first period, and programs a plurality of second devices in the panel via the second group of lines and senses the plurality of second devices via the first group of lines during a second period.

9. The driver IC of claim 7, wherein the first group of lines comprise odd columns of lines among the plurality of lines, and the second group of lines comprise even columns of lines among the plurality of lines.

* * * * *